US005124715A

United States Patent [19]

Homer

[11] Patent Number: 5,124,715

[45] Date of Patent: Jun. 23, 1992

[54] HINGE PIN ASSEMBLY FOR WINDOW SHADE RADAR MEMBRANE

[75] Inventor: Peter K. Homer, Langhorne, Pa.

[73] Assignee: Grumman Aerospace Corporation, Bethpage, N.Y.

[21] Appl. No.: 580,583

[22] Filed: Sep. 11, 1990

[51] Int. Cl.[5] ..... H01Q 1/120; E05F 1/080

[52] U.S. Cl. ..... 343/882; 343/880; 16/286

[58] Field of Search ..... 52/79.5, 645, 646; 403/91, 92, 113, 117; 343/878-882, 915, 916, DIG. 2; 16/286

[56] References Cited

U.S. PATENT DOCUMENTS

| | | | |
|---|---|---|---|
| 4,042,991 | 8/1977 | Macy et al. | 52/645 |
| 4,715,159 | 12/1987 | Hijazi | 52/646 |
| 4,814,784 | 3/1989 | Pallmeyer | 343/DIG. 2 |

OTHER PUBLICATIONS

W. Schneider, Space Station Structures, Large Space Antenna Systems Tech.-1984 Dec. 4-6, 1984 pp. 375-389.

*Primary Examiner*—Michael C. Wimer
*Assistant Examiner*—Peter Toby Brown
*Attorney, Agent, or Firm*—Pollock, VandeSande & Priddy

[57] ABSTRACT

Each antenna plane of a multi-layer radar membrane is secured at its edges to a hinge bar assembly. The purpose of the hinge bar assembly is to expand the layers, normally collapsed during a stowed condition, to parallel spaced layers when deployed. Each hinge assembly includes double bars pivotally mounted to a base section, the latter being snap-fastened to a ground plane. The ends of the hinge bars are snap-fastened to corresponding antenna plane strips and the central portion of each hinge bar has a spring extending outwardly therefrom for securement to a base abutment. Thus, when the membranes are freed from external restraint in preparation of deployment, the springs pivot the hinge bars to a generally perpendicular relationship with respect to the ground plane and antenna planes thus separating oppositely positioned antenna planes to the desired tensioned and parallel spaced relationship with respect to the ground plane.

6 Claims, 2 Drawing Sheets

HINGE PIN ASSEMBLY FOR WINDOW SHADE RADAR MEMBRANE

RELATED APPLICATIONS

This invention relates to the technology of copending U.S. patent applications Ser. No. 07/573,808; 07/580,478, now U.S. Pat. No. 5,081,467; and U.S. Ser. No. 07/580,584 now U.S. Pat. No. 5,049,894 by the same inventor and assigned to the same assignee.

FIELD OF THE INVENTION

The present invention relates to a space-fed phased array radar antenna of the window shade type, and more particularly to a hinge pin assembly for the membrane component of such a radar.

BACKGROUND OF THE INVENTION

The prior art includes a "window shade" deployed space-fed phased array radar antenna which is particularly suited for use in space. The rolled antenna is advantageous because it minimizes storage space aboard a spacecraft. When the spacecraft achieves selected orbit, the antenna is deployed and the "window shade" structure becomes unrolled to a fully expanded operative condition. Such an antenna consists of a low-power RF feed which illuminates a lens aperture membrane. Active transmit/receive (T/R) modules in the aperture membrane receive radar pulses from the ground, amplify them, and perform beam-steering phase shifts so that the signal may be re-transmitted toward a target of interest in space. The reflected energy is received in reverse order, being amplified by the T/R modules then focused back onto the space feed. Radar processors and supporting subsystems are located in a bus at the base of a feed mast. A tensioned three-layer membrane constitutes the aperture and provides a very lightweight, yet sufficiently flat, aperture plane. Array flatness requirements for the space-fed approach are less severe than for corporate-fed approaches by an order of magnitude. The membrane aperture can be rolled up onto a drum resulting in a simple, compact, and repeatable method for deployment/retraction of the antenna.

When the antenna is deployed, it is necessary to space the antenna planes from a common ground plane. This cannot be done with simple spacers because in the stowed condition the planes are compacted against one another in order to save space. Thus, it is necessary to have some sort of hinged spacer which extends the planes in parallel spaced relationship to one another when deployed. In the prior art each antenna plane is held in place by two Vespel springs which are attached to adjacent antenna planes using hinge pins. In addition, one hinge bar is pinned to the ground plane and antenna planes on either side to maintain separation between the three membrane layers. Each hinge bar installation currently requires three pins plus a doubler (base) on the ground plane. The installation of the current hinge pins requires time-consuming hand assembly.

BRIEF DESCRIPTION OF THE PRESENT INVENTION

The present invention presents a simplified hinge bar assembly which is less costly to manufacture and reduces assembly costs for the antenna. With the present invention an injection molded plastic assembly is employed which consists of two hinge bars and two identical base parts, all of which snap together. The base plates are first installed to the ground plane using retainer snaps which protrude through alignment holes pre-punched in the ground plane. The hinge bar details then snap into place within the assembled base. The double hinge bar design of the present invention eliminates the need for the antenna plane springs to absorb inter-plane shear that results when the layers of a membrane are rolled onto a drum. Slight tension is maintained in the deployed antenna plane "shingles" because the hinge bars are molded such that slight bending deformations are induced when the antenna planes are installed. Tension in the antenna plane on one side of the ground plane is reacted by the antenna plane on the other side. Adjacent "shingles" in a string are no longer joined. Buckled springs molded to the hinge bars provide force to cause the hinge bars to swing out during deployment. By virtue of the present hinge bar assembly, a number of major advantages becomes realized as follows.

There is the elimination of the antenna plane springs and pins currently in use. In addition to reduced parts count and labor savings, this results in increased reliability of the three-layer membrane system since failure of the antenna plane connections will not affect adjacent antenna planes in the string as is used in prior art designs.

Further, automated mass production of all hinge bar details is possible using injection molding. This reduces costs for the large number of parts required and also results in tighter detail parts tolerances than for other methods. Still further, the amount of time and labor required to install or replace these units is greatly reduced.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
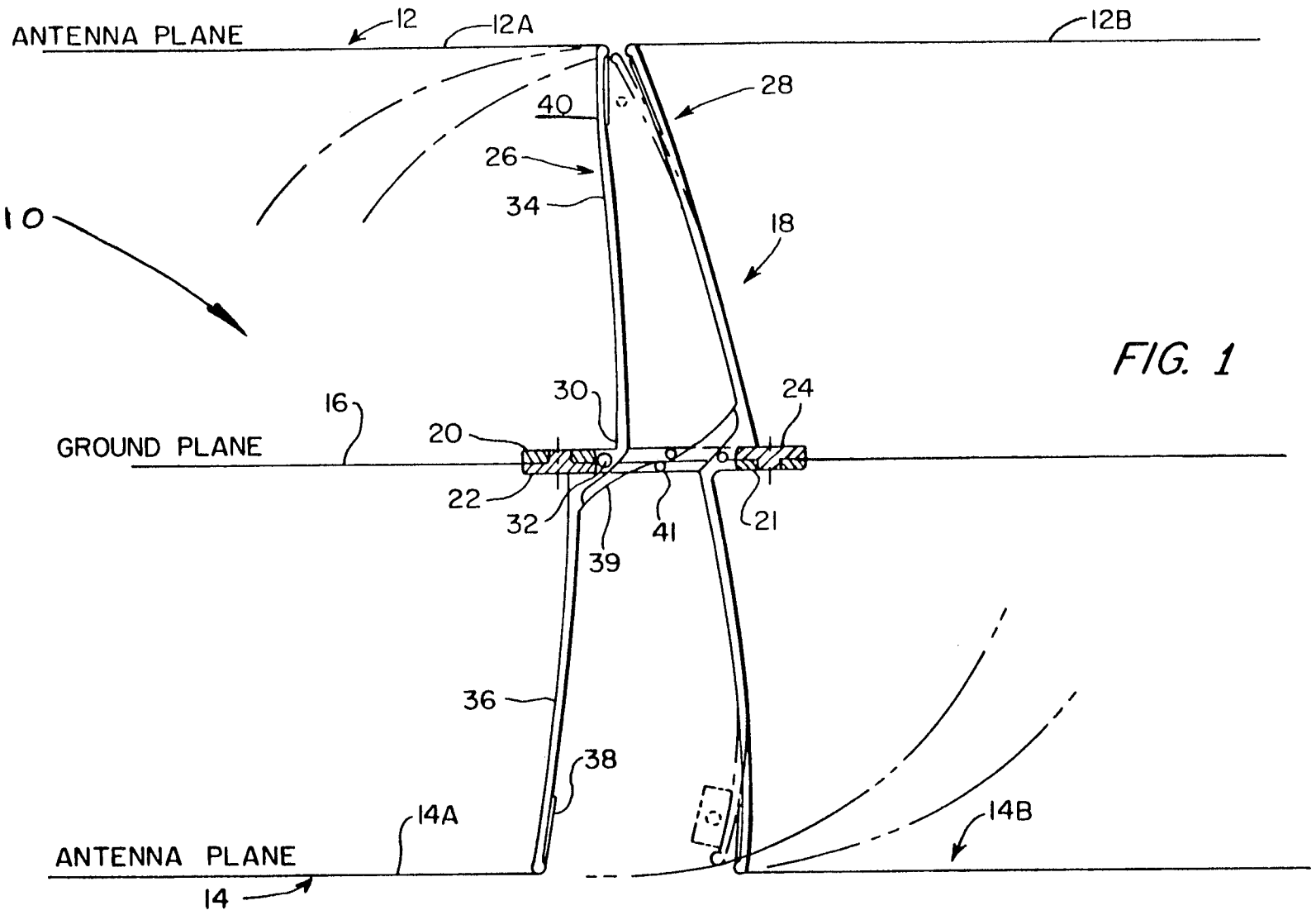
FIG. 1 is an elevational view of the present hinge bar assembly when the multi-layer membrane is deployed.

FIG. 1 illustrates the present hinge bar assembly in a deployed condition. The radar multi-layer membrane is generally indicated by reference numeral 10 and is seen to include three layers, including two antenna planes 12 and 14 separated by a ground plane 16, the latter being positioned medially of the antenna planes. The antenna plane 12 includes two adjacently positioned and co-planar strips 12A and 12B while the opposite antenna plane 14 likewise includes two adjacently positioned co-planar strips 14A and 14B. The materials for fabricating the various planes are well known in the art. The purpose of the hinge bar assembly is to act as collapsible spacers for the various planes when the tri-layered membrane 10 is deployed as shown in FIG. 1. The hinge bar assembly is generally indicated by reference numeral 18 and is seen to include two adjacently positioned hinge bars 26 and 28 which pivot with respect to a base which is installed in the ground plane 16. The base itself actually comprises two plate members 20 and 21 having respective hinge bars 26 and 28 pivotally connected thereto. The plate sections are preferably molded from a plastic material and include openings therein to permit insertion of snap fasteners 22 and 24 from opposite surfaces of the ground plane thus securely fastening the base sections to the ground plane.

The hinge bars are generally symmetrical relative to the ground plane and have central apertures formed therein for receiving integrally formed snap members 32 which extend from respective base sections. By virtue of the snap fasteners 22, 24 for the base and the snap members 32 for pivotally mounting the hinge bars, assembly of the hinge bar assembly is quite simple and rapid.

Figure 3:
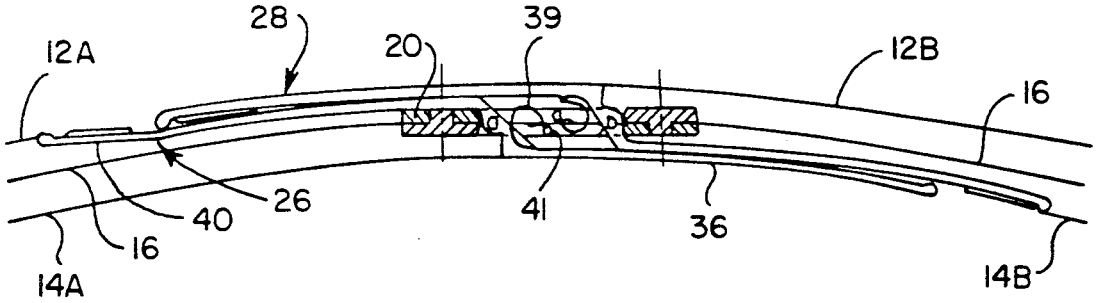
FIG. 3 is a elevational view illustrating the hinge bar assembly in a collapsed position when the multi-layer membrane is stowed.

As seen in FIG. 3, when the tri-layered membrane 10 is stowed, the upper sections 34 (FIG. 1) of hinge bars 26 and 28 pivot to the left side of the illustrated ground plane, along the arcs indicated by dotted lines. Likewise, the lower sections 36 of hinge bars 26 and 28 pivot to the right along the arcs indicated by dotted lines. In the stowed condition the hinge bars are collapsed along opposite surfaces of the ground plane. When the tri-layered membrane becomes removed from a stowed condition, it is necessary to erect the members so that they assume the generally parallel spaced relation shown in the deployed state of FIG. 1. In order to pivot the hinge bars 26 and 28, integrally molded springs 39 extend between the central portion 30 of each hinge bar and a centrally located abutment 41 extending from a respective base section. As soon as restraints (not shown) are removed from the tri-layered membrane 10, the springs urge the hinge bars into the illustrated upright position thereby extending the three planes to the depicted parallel spaced relationship.

Figure 2:
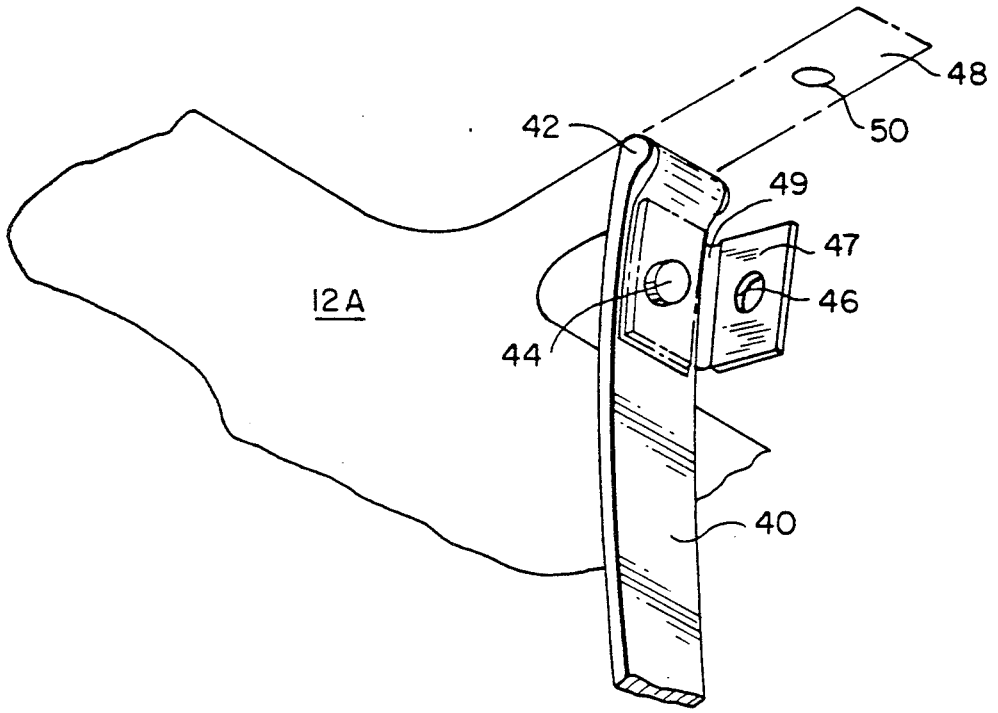
FIG. 2 is a perspective detailed view of the connection between a hinge bar and an antenna plane.

FIG. 2 illustrates the means for attaching an antenna plane to the outer ends 38 and 40 of a hinge bar. This is done by forming an integral extension 48 at the transverse end of each antenna plane strip (12A, 12B, 14A, 14B). A pre-punched alignment hole 50 is formed in the extension 48 and the extension is then wrapped around the bulbous hinge bar end 42 until the hole 50 is positioned over a molded male snap member 44. An aperture 46 is formed in a mating female snap member 47, the latter being hingedly mounted to the hinge bar by flap 49. By snapping the snap members together, the antenna plane strip is secured to the hinge bar. Slight tension is maintained in the deployed antenna plane strips because the hinge bars are molded such that slight bending deformations are induced when the antenna planes are installed. Tension in the antenna plane on one side of the ground plane is reacted by the antenna plane on the other side.

As thus far described it will be appreciated that the present hinge bar assembly offers great convenience and repeatable economies in the assembly of multi-layer membranes.

It should be understood that the invention is not limited to the exact details of construction shown and described herein for obvious modifications will occur to persons skilled in the art.

I claim:

1. A hinge bar structure for a sheet assembly, the sheet assembly having at least three layers, the structure comprising:

a base having two sections each of which contacts an opposite surface of a median layer;

means for snapping the base sections to the median layer;

at least one hinge bar pivotally mountable at a central portion thereof to the base and extending through the base;

snap means located at opposite ends of each hinge bar for securing respective outer layers to each hinge bar; and spring means connected between the central portion of each hinge bar and the base for biasing each hinge bar to a perpendicular position relative to the layers thereby orienting the layers in deployed spaced parallel planar relation.

2. The structure set forth in claim 1 wherein the spring means comprises a spring molded with a hinge bar central section and having a first end fixed to the central section while having an opposite end fixed to an abutment formed on the base.

3. The structure set forth in claim 1 wherein each snap means comprises a snap member extending from an opposite hinge bar end; and further wherein the opposite hinge bar end has an integrally formed apertured flap for snapping over the snap member;

wherein an extension of each outer layer has an opening positioned over the snap member and is retained by each snap means.

4. A hinge bar assembly for a multi-layer window shade radar membrane, the membrane having at least a medial ground plane and two antenna planes disposed in mutually parallel relation, the antenna planes including co-planar sections, and the hinge bar assembly comprising:

a base having two sections, each of which contacts an opposite surface of the ground plane;

means for snapping each base section to the ground plane;

two hinge bars pivotally mounted at a central portion thereof to the base, and extending through the base;

snap means located at opposite ends of each hinge bar for securing a section of a respective antenna plane thereto;

spring means connected between the central portion of each hinge bar and the base for swinging each hinge bar to a perpendicular position relative to the ground and antenna planes when restraint forces are removed from the ground and antenna planes which normally retain the antenna planes and hinge bar assembly in a compact stowed condition;

wherein attainment of the perpendicular position results in parallel spaced deployment of the ground and antenna planes.

5. The structure set forth in claim 4 wherein each snap means comprises a snap member extending from each end of the hinge bars;

and further wherein the ends have an integrally formed molded apertured flap for snapping over the snap member;

wherein an extension of each antenna plane has an opening formed therein and is positioned over the snap member and retained by each snap means.

6. The structure set forth in claim 5 wherein the spring means comprises a spring molded with a hinge bar central bar section and having a first spring end fixed to the hinge bar central section and having an opposite spring end fixed to an abutment formed on the base.

* * * * *